US006256052B1

(12) United States Patent
Yoneda

(10) Patent No.: US 6,256,052 B1
(45) Date of Patent: Jul. 3, 2001

(54) THERMAL HEAD

(75) Inventor: Junichi Yoneda, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/357,984

(22) Filed: Jul. 21, 1999

(30) Foreign Application Priority Data

Jul. 21, 1998 (JP) ..... 10-204972

(51) Int. Cl.[7] ..... B41J 2/335
(52) U.S. Cl. ..... 347/203
(58) Field of Search ..... 347/203, 200

(56) References Cited

U.S. PATENT DOCUMENTS 6,091,437 * 7/2000 Yoneda et al. ..... 347/203

FOREIGN PATENT DOCUMENTS 58-42472 3/1983 (JP) ..... B41J/3/20
63-78761 4/1988 (JP) ..... B41J/3/20
7-132628 5/1995 (JP) ..... B41J/2/335
10-119336 * 5/1998 (JP) ..... 347/203

* cited by examiner

*Primary Examiner*—Huan Tran
(74) *Attorney, Agent, or Firm*—Sughrue, Mion, Zinn, Macpeak & Seas, PLLC

(57) ABSTRACT

There is provided a thermal head having a protective film including a carbon-based protective layer and a lower insulating protective layer which is composed of one or more sub-layers and formed below the carbon-based protective layer, wherein at least one of the sub-layers of the lower protective layer contains not more than 5 atm % of oxygen. The protective layer has significantly reduced corrosion and wear and is protected from cracking and peeling, whereupon the thermal head obtained can have a sufficient durability to ensure that high reliability is exhibited over an extended period of time to perform thermal recording of high-quality images consistently over an extended period of operation.

4 Claims, 1 Drawing Sheet

THERMAL HEAD

BACKGROUND OF THE INVENTION

This invention relates to the art of thermal heads for thermal recording which are used in various types of printers, plotters, facsimile, recorders and the like as a recording device.

Thermal materials comprising a thermal recording layer on a substrate of a film or the like are used to record images produced in diagnosis by ultrasonic scanning (sonography).

This recording method, also referred to as thermal recording, eliminates the need for wet processing and offers several advantages including convenience in handling. Hence, in recent years, the use of the thermal recording system is not limited to small-scale applications such as diagnosis by ultrasonic scanning and an extension to those areas of medical diagnoses such as CT, MRI and X-ray photography where large and high-quality images are required, is under review.

As is well known, thermal recording involves the use of a thermal head having a glaze, in which heating elements comprising heaters and electrodes, used for heating a thermal material to record an image are arranged in one direction (main scanning direction) and, with the glaze urged at small pressure against the thermal material, the two members are moved relative to each other in the auxiliary scanning direction perpendicular to the main scanning direction. Energy is applied to the heating elements of the respective pixels in the glaze in accordance with image data to be recorded which were supplied from an image data supply source such as MRI or CT, in order to heat the thermal recording layer of the thermal material, thereby performing image recording through color formation.

A protective film is formed on the surface of the glaze of the thermal head in order to protect the heaters for heating a thermal material, the associated electrodes and the like. Therefore, it is this protective film that contacts the thermal material during thermal recording and the heaters heat the thermal material through this protective film so as to perform thermal recording.

The protective film is usually made of wear-resistant ceramics; however, during thermal recording, the surface of the protective film is heated and kept in sliding contact with the thermal material, so it will gradually wear and deteriorate upon repeated recording.

If the wear of the protective film progresses, density unevenness will occur on the thermal image or a desired protective strength can not be maintained and, hence, the ability of the film to protect the heaters is impaired to such an extent that the intended image recording is no longer possible (the head has lost its function).

Particularly in the applications such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective film of the thermal head, making wear and corrosion (or wear due to corrosion) more likely to progress.

With a view to preventing the wear of the protective film on the thermal head and improving its durability, a number of techniques to improve the performance of the protective film have been considered. Among others, a carbon-based protective film (hereinafter referred to as a carbon protective layer) is known as a protective film excellent in resistance to wear and corrosion.

Thus, Examined Published Japanese Patent Applications (KOKOKU) No. 61-53955 and No. 4-62866 (the latter being the divisional application of the former) disclose a thermal head excellent in wear resistance and response which is obtained by forming a very thin carbon protective layer having a Vickers hardness of 4500 kg/mm$^2$ or more as the protective film of the thermal head and a method of manufacturing the thermal head, respectively.

Unexamined Published Japanese Patent Application (KOKAI) No. 7-132628 discloses a thermal head which has a dual protective film comprising a lower silicon-based compound layer and an overlying diamond-like carbon layer, said protective film having wear and breakage significantly reduced, thereby ensuring that high-quality images can be recorded over an extended period of time.

The carbon protective layer has properties quite similar to those of a diamond, including a very high hardness and chemical stability. Hence the carbon protective layer presents sufficiently excellent properties to prevent wear and corrosion which may be caused by the sliding contact with thermal materials.

The carbon protective layer is excellent in wear resistance, but brittle because of its hardness, that is, low in tenacity. Therefore, a thermal shock or stress due to heating of heating elements, a stress due to a difference in the coefficient of thermal expansion between the carbon protective layer and the neighboring layer, a mechanical impact due to a foreign matter entered between the thermal material and the thermal head (glaze) during recording, or other factors may bring about rather easily, cracking or peeling.

If cracking or peeling is caused in the protective layer, wear, corrosion and also wear due to corrosion progress, leads to the reduction of the durability of the thermal head. The thermal head is not capable of exhibiting high reliability over an extended period of time.

SUMMARY OF THE INVENTION

The present invention has been accomplished under these circumstances and has as an object providing a thermal head having a carbon-based protective layer, said protective layer having significantly reduced corrosion and wear and being protected from cracking and peeling due to heat or a mechanical impact, thereby enabling the thermal head to have a sufficient durability to ensure that high reliability can be exhibited over an extended period of time to perform thermal recording of high-quality images consistently over an extended period of operation.

In order to achieve the above object, the invention provides a thermal head having a protective film of heating elements, said protective film comprising a carbon-based protective layer and a lower insulating protective layer which is composed of one or more sub-layers and formed below said carbon-based protective layer, wherein at least one of said sub-layers of said lower protective layer contains not more than 5 atm % of oxygen.

In a preferred embodiment, at least, one of said sub-layers which is located uppermost in said lower protective layer contains not more than 5 atm % of oxygen.

In another preferred embodiment, said protective film further includes between said carbon-based protective layer and said lower protective layer, an intermediate protective layer which is based on at least one component selected from a group consisting of metals of Groups IVA, VA and VIA, and silicon and germanium, and which is composed of one or a plurality of sub-layers.

When said intermediate protective layer is included, it is preferred that said intermediate protective layer also contains not more than 5 atm % of oxygen.

When said intermediate protective layer has the plurality of sub-layers, at least one of said sub-layers contains preferably not more than 5 atm % of oxygen. In particular, all of said sub-layers contain preferably not more than 5 atm % of oxygen.

DETAILED DESCRIPTION OF THE INVENTION

The thermal head of the invention will now be described in detail with reference to the preferred embodiments shown in the accompanying drawings.

Figure 1:
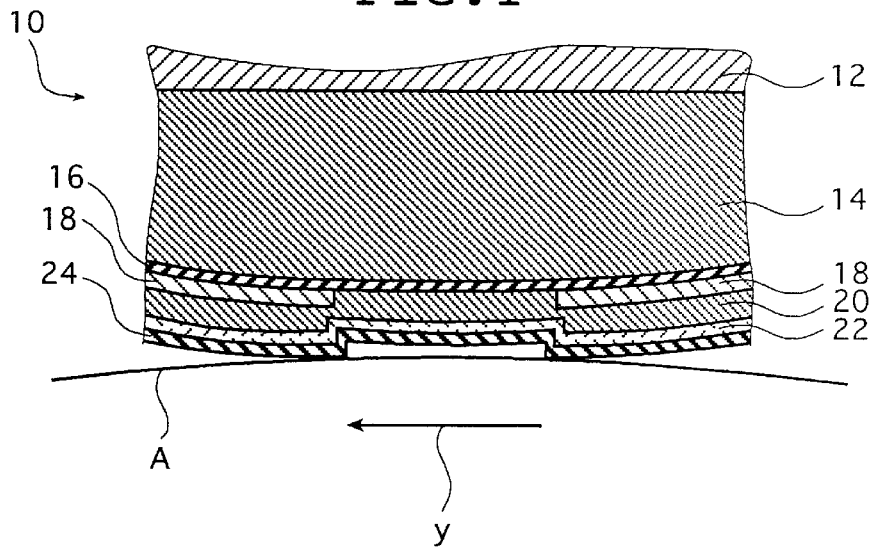
FIG. 1 s a schematic cross sectional view showing the structure of a heating element in the thermal head of the invention.

FIG. 1 shows a schematic cross sectional view of a heating element in the thermal head of the invention.

The thermal head 10 shown in FIG. 1 is capable of recording on thermal sheets of up to, for example, B4 size at a recording (pixel) density of, say, about 300 dpi. Except for the protective film, the head has a known structure in that heating elements performing thermal recording on a thermal material A are arranged in one direction, that is in a main scanning direction (which is normal to the plane in FIG. 1).

It should be noted that the thermal head 10 of the invention is not particularly limited in such aspects as the width (in the main scanning direction), resolution (recording density) and recording gradation; preferably, the head width ranges from 5 cm to 50 cm, the resolution is at least 6 dots/mm (ca. 150 dpi), and the recording gradation consists of at least 256 levels.

The thermal material A used for thermal recording in the thermal head 10 of the invention is of an ordinary type which comprises a substrate of a transparent polyethylene terephthalate (PET) film or the like which is overlaid with a thermal recording layer. A material containing a lubricant is preferably used as the thermal material A in such an aspect as preferred sticking reduction.

As shown in FIG. 1, to form the glaze of the thermal head 10, the top of a substrate 12 (which is shown to face down in FIG. 1 since the thermal head 10 is pressed downward against the thermal material A) is overlaid with a glaze layer (heat accumulating layer) 14 which, in turn, is overlaid with a heater (heat-generating resistor) 16 which, in turn, is overlaid with electrodes 18 which, in turn, is overlaid with a protective film which protects the heating element comprising the heater 16 and the electrodes 18.

The protective film in the illustrated thermal head 10 is composed of three layers: a lower protective layer 20 superposed on the heater 16 and the electrodes 18, an intermediate protective layer 22 formed on the lower protective layer 20 and a carbon-based upper protective layer, or carbon protective layer 24 which is formed on the intermediate protective layer 22.

The thermal head 10 of the invention has essentially the same structure as known versions of thermal head except for the protective film. Therefore, the arrangement of other layers and the constituent materials of the respective layers are not limited in any particular way and various known versions may be employed. Specifically, the substrate 12 may be formed of various electrical insulating materials including heat-resistant glass and ceramics such as alumina, silica and magnesia; the glaze layer 14 may be formed of heat-resistant glass, heat resistant resins including polyimide resin and the like; the heater 16 may be formed of heat-generating resistors such as Nichrome (Ni—Cr), tantalum metal and tantalum nitride; and the electrodes 18 may be formed of electrically conductive materials such as aluminum, gold, silver and copper.

Heating elements on the glaze are known to be available usually in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing. The thermal head 10 for use in the invention may be formed by either method.

The material of the lower protective layer 20 to be formed on the thermal head 10 of the invention is not limited in any particular way and the lower protective layer 20 may be formed of a variety of known materials as long as they have insulating properties and sufficient heat resistance, corrosion resistance and wear resistance to serve as the protective film of the thermal head. A variety of ceramic materials are preferably used.

Specific materials include silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures thereof. Among others, nitrides and carbides are preferably used in such aspects as easy film deposition, manufacturing cost, and resistance to mechanical wear and chemical wear. Silicon nitride, silicon carbide and SIALON are more preferably used. Additives such as metals may be incorporated in small amounts into the lower protective layer 20 to adjust physical properties thereof.

Methods of forming the lower protective layer 20 are not limited in any particular way and known methods of forming ceramic films (layers) such as sputtering, especially magnetron sputtering, and CVD, especially plasma-assisted CVD may be employed by applying the aforementioned thick-film and thin-film processes and the like. Among others, CVD is preferably employed.

As is well known, CVD is a technique of film deposition in which thermal or optical energy is applied to gaseous materials in a reaction chamber to induce various chemical reactions, thereby depositing substances on the substrate. The lower protective layer 20 which is very fine and has no defects such as cracks can be formed by means of CVD, whereupon a thermal head excellent in durability and advantageous in image quality can be obtained.

The thickness of the lower protective layer 20 is not limited to any particular value but it ranges preferably from about 0.2 $\mu$m to about 20 $\mu$m, more preferably from about 2 $\mu$m to about 15 $\mu$m. If the thickness of the lower protective layer 20 is within the stated ranges, preferred results are obtained in various aspects such as the balance between wear resistance and heat conductivity (that is, recording sensitivity).

The lower protective layer 20 may comprise multiple sub-layers. In this case, the multiple sub-layers may be formed of different materials or multiple sub-layers different in density may be formed of one material. Alternatively, the two methods may be combined to obtain sub-layers.

The thermal head 10 of the invention has a protective film of which the basic structure is as follows: The protective film comprises at least the carbon protective layer and the lower protective layer 20 formed below the carbon protective layer; and at least one sub-layer of the lower protective layer 20 contains not more than 5 atm %, preferably not more than 3 atm % of oxygen.

As described above, the carbon protective layer 24 has chemically high stability, and advantageously protects the lower protective layer 20, the electrodes 18 and the heater 16 from chemical corrosion, thereby providing a thermal head with preferred durability and prolonged service life. According to the invention, the structure as described above makes it possible to improve the adhesion of the carbon protective layer 24 to the lower protective layer 20 and further to the intermediate protective layer 22, and to protect the carbon protective layer 24 from cracking and peeling caused by a thermal shock or stress, a stress due to a difference in the coefficient of thermal expansion between the carbon protective layer 24 and the underlying layers, or a mechanical impact due to a foreign matter as described above, whereupon a thermal head having more prolonged service life and more excellent in durability and reliability is obtained.

Methods of forming the lower protective layer 20 which contains not more than 5 atm % of oxygen are not limited in any particular way, and various methods can be used in accordance with the composition or other factors.

For example when the lower protective layer 20 is formed by sputtering, the amount of oxygen to be supplied to the system during film deposition is adjusted. In general, when a ceramic material is deposited by sputtering, oxygen gas is mixed with argon gas used for plasma generation in order to ensuring competence for mass production. The amount of the oxygen gas can be adjusted to control the amount of oxygen included in the film. The lower protective layer 20 in which the oxygen content is not more than 5 atm % can be formed by reducing the amount of the oxygen gas. It should be however noted that conditions for film deposition can be determined for example by an experiment.

When forming the lower protective layer 20 containing not more than 5 atm % of oxygen by means of CVD, a method is illustrated in which film deposition is usually performed while controlling the flow rate of the oxygen gas used as a reactive gas in the plasma-assisted CVD for generating plasma by means of radio frequency (RF) or microwave ($\mu$W).

For example, the relation between the flow rate of the oxygen as the reactive gas and the oxygen amount in the film is determined by an experiment, and the oxygen flow rate during film deposition is accordingly adjusted. The oxygen amount in the lower protective layer 20 can be thus controlled.

The lower protective layer 20 may include a plurality of sub-layers, as described above. In this case, at least one of the sub-layers in the lower protective layer 20 should contain not more than 5 atm % of oxygen.

However, in order to impart to the carbon protective layer 24 more preferred adhesion to the neighboring layer, the sub-layer nearest to the carbon protective layer 24, that is, the uppermost sub-layer, especially all of the sub-layers contain preferably not more than 5 atm % of oxygen.

The illustrated thermal head 10 has a protective film of three-layer structure, in which the lower protective layer 20 as described above is coated with the intermediate layer 22 which is, in turn, coated with the carbon protective layer 24.

As described above, a thermal head having an extremely prolonged service life can be obtained by forming the carbon protective layer 24 on the lower protective layer 20. If the intermediate layer 22 is further inserted therebetween, the adhesion of the lower protective layer 20 to the carbon protective layer 24 and the shock absorption can be improved, thereby providing a thermal head with prolonged service life which is more excellent in durability and long term reliability.

The intermediate protective layer 22 formed on the thermal head 10 is preferably based on at least one component selected from the group consisting of metals in Group IVA (titanium group), Group VA (vanadium group) and Group VIA (chromium group) of the periodic table, as well as silicon (Si) and germanium (Ge) in such aspects as the adhesion between the upper carbon protective layer 24 and the lower protective layer 20 and the durability of the carbon protective layer 24.

Preferred specific examples include Si, Ge, titanium (Ti), tantalum (Ta), molybdenum (Mo) and mixtures thereof. Among others, Si and Mo are more preferably used in the binding with carbon and other aspects. Most preferably, Si is used.

Methods of forming the intermediate protective layer 22 are not limited in any particular way and any known film deposition methods may be used in accordance with the material of the intermediate protective layer 22 by applying the aforementioned thick-film and thin-film processes and the like. A preferred method includes sputtering, but plasma-assisted CVD is also available with advantage.

The intermediate protective layer 22 may also comprise multiple sub-layers. In this case, multiple sub-layers may be formed of different materials or multiple sub-layers different in density may be formed of one material. Alternatively, the two methods may be combined to obtain sub-layers.

According to the invention, it is preferred that the intermediate layer 22 also contains not more than 5 atm % of oxygen.

When the intermediate layer 22 comprises multiple sub-layers, at least one sub-layer, especially all of the sub-layers contain preferably not more than 5 atm % of oxygen.

Prior to forming the intermediate protective layer 22, lapping treatment and etching treatment are preferably performed on the surface of the lower protective layer 20. Thus, the adhesion between the lower protective layer 20 and the intermediate protective layer 22 and the adhesion between the intermediate protective layer 22 and the carbon protective layer 24 can be improved, leading to the improvement in the durability of the thermal head.

The surface roughness of the lower protective layer 20 in these treatments is not limited to any particular value, but the surface roughness expressed by "Ra" value is preferably in the range of from 1 nm to 0.1 $\mu$m.

In the illustrated thermal head 10, the carbon-based protective layer 24 is formed on the intermediate layer 22.

It should be noted that the carbon-based protective layer 24 as used in the present invention refers to a carbon layer containing not less than 50 atm % of carbon, and preferably comprising carbon and inevitable impurities. In the thermal head of the invention, suitable components to be incorporated in addition to carbon to form the carbon protective layer 24 include hydrogen, nitrogen, fluorine, Si and Ti. In the case of hydrogen, nitrogen and fluorine, the content thereof in the carbon protective layer 24 is preferably less than 50 atm %, and in the case of Si and Ti, the content thereof in the carbon protective layer 24 is preferably not more than 20 atm %.

Methods of forming the carbon protective layer 24 are not limited in any particular way and any known film deposition methods may be used in accordance with the composition of the carbon protective layer 24 to be formed. Preferred methods include sputtering, especially magnetron sputtering, and CVD, especially plasma-assisted CVD.

The carbon protective layer 24 may be formed while heating to about 50° C.–400° C., especially to a temperature at which the thermal head 10 is used. In this method, the adhesion of the carbon protective layer 24 to the intermediate protective layer 22 and the lower protective layer 20 can be further improved, and more excellent durability can be imparted to the carbon protective layer 24 which is protected from cracking and peeling caused by a thermal shock and a mechanical impact due to a foreign matter entering during thermal recording, as well as alteration and attrition due to high power recording. It should be noted, however, that heating can be performed by a method using a heating device such as a heater, or a method of energizing the thermal head.

The hardness of the carbon protective layer 24 is not limited to any particular value as long as the carbon protective layer 24 has a sufficient hardness to serve as the protective film of the thermal head. Thus, the carbon protective layer 24 having a Vickers hardness of from 3000 $kg/mm^2$ to 5000 $kg/mm^2$ is advantageously illustrated. The hardness may be constant or varied in the thickness direction of the carbon protective layer 24. In the latter case, the hardness variation may be continuous or stepwise.

The intermediate protective layer 22 and the carbon protective layer 24 in the thermal head 10 of the invention are not limited in thickness to any particular values. When the protective film is comprised of the three layers of the lower protective layer 20, the intermediate layer 22 and the carbon protective layer 24, the intermediate protective layer 22 has preferably a thickness of from 0.05 $\mu$m to 1 $\mu$m, more preferably from 0.1 $\mu$m to 1 $\mu$m, and the carbon protective layer 24 has preferably a thickness of from 0.5 $\mu$m to 5 $\mu$m, more preferably from 1 $\mu$m to 3 $\mu$m.

In the case of the intermediate protective layer 22 which is much thicker than the carbon protective layer 24, cracking and peeling may often take place in the intermediate protective layer 22. When the intermediate protective layer 22 is much thinner than the carbon protective layer 24, the intermediate layer 22 can not exhibit sufficient functions to be performed as the intermediate layer 22. Therefore, if the thicknesses of the intermediate protective layer 22 and the carbon protective layer 24 are within the stated ranges, the adhesion of the intermediate protective layer 22 to the lower protective layer 20 and the shock absorption thereof as well as the functions of the carbon protective layer 24 including durability can be consistently realized in a well balanced manner.

It should be noted, however, that the protective film formed on the thermal head of the invention is not limited to the structure as described above, and a variety of structures can be used, as far as the protective film has the carbon protective layer 24 and the lower protective layer 20 formed below the carbon protective layer 24, and the bottommost layer of the protective film contains not more than 5 atm % of oxygen.

The protective film as described above may be replaced with a protective film of two-layer structure in which the carbon protective layer 24 is directly formed on the lower protective layer 20 without using the intermediate layer 22.

In this case, the thickness of the lower protective layer 20 ranges preferably from 0.5 $\mu$m to 50 $\mu$m, especially from 2 $\mu$m to 20 $\mu$m, and the thickness of the carbon protective layer 24 ranges preferably from 0.1 $\mu$m to 5 $\mu$m, especially from 1 $\mu$m to 3 $\mu$m.

Alternatively, after the carbon protective layer 24 is formed, a lubricant or wax may be applied to the surface thereof, and where appropriate, be baked by heating with a heater or by driving the thermal head. In this case, application and baking of the lubricant or wax can be performed after the carbon protective layer 24 is etched with oxygen. The lubricant and the wax are not limited in any particular way, and a variety of types can be used. For example, a lubricant contained in the thermal material A, a coating agent having heat resistance, preferably a coating agent excellent in lubricating properties are available.

Further, after the carbon protective layer 24 is formed, a protective film containing silicon nitride, silicon carbide, Si or Mo as described above may be formed thereon.

Figure 2:
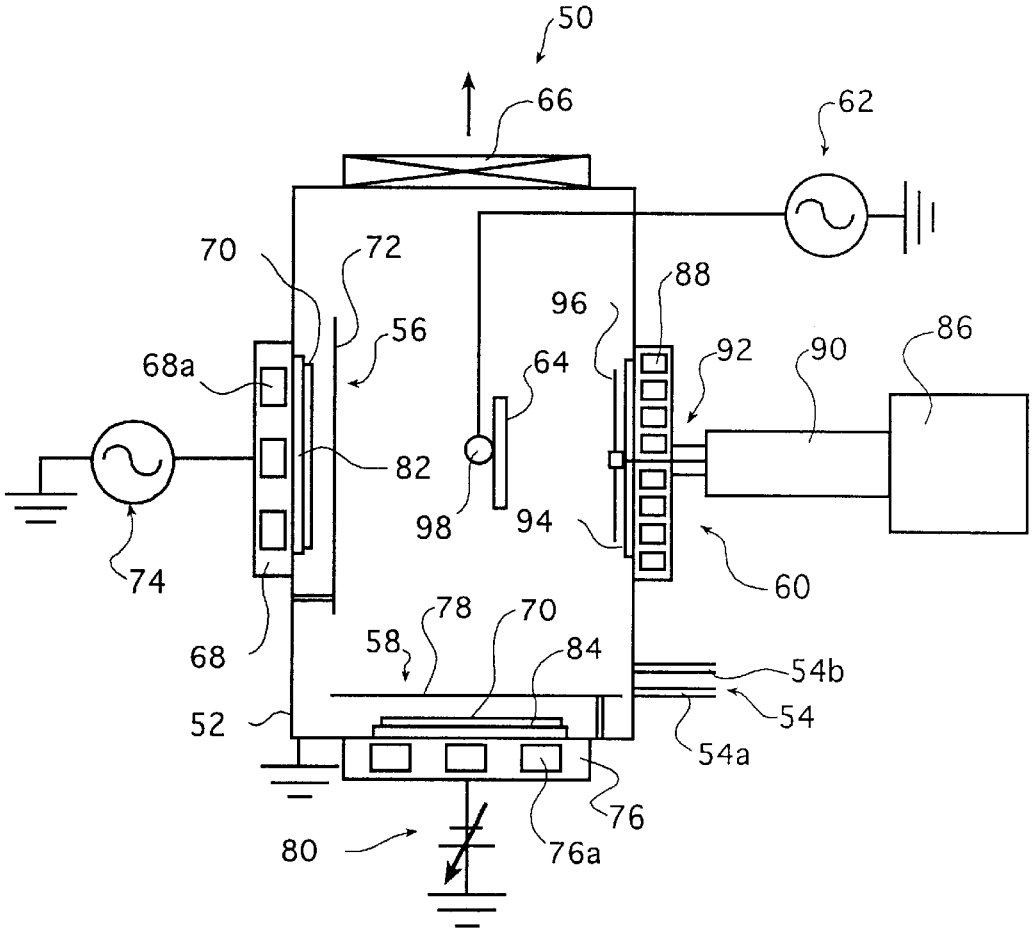
FIG. 2 shows the concept of an exemplary film deposition apparatus for use in fabricating the thermal head of the invention.

FIG. 2 shows the concept of a film deposition apparatus suitable for forming the protective film of the thermal head of the invention.

The illustrated film deposition apparatus generally indicated by 50 in FIG. 2 comprises a vacuum chamber 52, a gas introducing section 54, a first sputter device 56, a second sputter device 58, a plasma generating device 60, a bias source 62 and a substrate holder 64 as the basic components.

The film deposition apparatus 50 comprises three film deposition devices located in the system or the vacuum chamber 52, the two being performed by sputtering and the other by plasma-assisted CVD. A plurality of layers which are different in the composition can be formed continuously.

Therefore, the film deposition apparatus 50 can be used to form the lower protective layer 20, the intermediate layer 22 and the carbon protective layer 24 with a high efficiency by means of sputtering using different targets or the combination of sputtering with plasma-assisted CVD.

The vacuum chamber 52 is preferably formed of a non-magnetic material such as SUS 304. A vacuum pump-down device 66 is provided to evacuate the interior of the film deposition system to depress the pressure. Those sites of the vacuum chamber 52 where plasma develops or an arc is produced by plasma generating electromagnetic waves may be covered with an insulating member, which may be made of insulating materials including MC nylon, Teflon (PTFE) or the like.

The gas introducing section 54 consists of two parts 54*a* and 54*b*, the former being a site for introducing a plasma generating gas and the latter for introducing a reactive gas for use in the plasma-assisted CVD, into the vacuum chamber 52.

Inert gases such as argon, helium and neon are used as the plasma generating gas. Examples of the reactive gas for producing the carbon protective layer 24 are the gases of hydrocarbon compounds such as methane, ethane, propane, ethylene, acetylene and benzene. Examples of the reactive gas for producing the intermediate protective layer 22 are various gases including materials used to form the intermediate protective layer 22.

Further, examples of the reactive gas for producing the lower protective layer 20 are various gases including materials used to form the lower protective layer 20. Specifically, a mixed gas of silane, nitrogen and oxygen or the like can be used as the reactive gas when producing a silicon nitride film as the lower protective layer 20.

To effect sputtering, a target 70 to be sputtered is placed on each of cathodes 68 and 76, which are rendered at negative potential and a plasma is generated on the surface of the target 70, whereby atoms are struck out of the target 70 and deposit on the surface on the opposed substrate to form the film.

The first sputter device 56 and the second sputter device 58 are intended for sputtering film deposition on the surface of the substrate. The former comprises the cathode 68, the area where the target 70 is to be placed, a shutter 72, a radio-frequency (RF) power supply 74 and other components. The latter comprises the cathode 76, the area where the target 70 is to be placed, a shutter 78, a direct current (DC) power supply 80 and other components.

As seen from the above configuration, the first sputter device 56 and the second sputter device 58 have basically a similar configuration except that the power supply and the positions of the respective components are different. Therefore, we now describe the first sputter device 56 as a typical example except for the different portions.

In order to generate a plasma on the surface of the target 70 in the second sputter device 58, the negative side of the DC power supply 80 is directly connected to the cathode 76, and sputtering voltage is applied.

The output and performance of the two power supplies are not limited in any particular way, and a device having the necessary and sufficient performance to produce a film of interest can be selected. In case of an apparatus used to form the carbon protective layer 24, for example, a DC power supply can be used which is at negative potential capable of producing a maximal output of 10 kW, and which is adapted to be capable of pulse modulation at frequencies in the range of 2 to 100 kHz by means of a modulator.

In the illustrated case, a backing plate 82 (or 84 in the second sputter device 58) made of oxygen-free copper, stainless steel or the like is first fixed to the cathode 68 and the target 70 is then attached to the backing plate 82 with In-based solder or by mechanical fixing means.

Preferred materials of the target 70 used to form the lower protective layer 20 include various ceramic materials such as $Si_3N_4$ and SIALON as described above. Preferred materials of the target 70 used to form the intermediate layer 22 include metals of the Groups IVA, VA and VIA and monocrystalline Ge and Si and the like. The target 70 used to form the carbon protective layer 24 is preferably made of sintered carbon, glassy carbon or the like.

The illustrated apparatus performs magnetron sputtering, in which magnets 68*a* (or 76*a*) are placed within the cathode 68 and a sputtering plasma is confined within a magnetic field formed on the surface of the target 70. Magnetron sputtering is preferred since it achieves high deposition rates.

The illustrated film deposition apparatus 50 is used to form the carbon protective layer 24 by means of the plasma-assisted CVD with microwave ECR discharge which generate plasma with microwave in the ECR magnetic field. The plasma generating device 60 comprises a microwave source 86, magnets 88, a microwave guide 90, a coaxial transformer 92, a dielectric plate 94 and a radial antenna 96 and the like.

A source having the necessary and sufficient output to produce the carbon protective layer 24 can appropriately be selected as the microwave source 86. Permanent magnets or electromagnets capable of forming a desired magnetic field can be appropriately used as the magnets 88 for generating the ECR magnetic field. The microwave is introduced into the vacuum chamber 52 by means of the microwave guide 90, the coaxial transformer 92, the dielectric plate 94 and the like.

The substrate holder 64 is used to fix the portion to be coated with the protective film in the thermal head 10 (or the substrate) in position. The film deposition apparatus 50 as shown in FIG. 2 comprises these three film deposition devices. The substrate holder 64 is held on a rotary base 98 which rotates to move the substrate holder 64 so that the glaze on the substrate holder 64 can be opposed to the respective film deposition devices, that is, the sputter devices 56 and 58, and the plasma generating device 60 by means of the plasma-assisted CVD.

The distance between the substrate holder 64 and the target 70 or the radial antenna 96 can be adjusted by a known method and a distance that provides a uniform thickness profile may be set appropriately.

As described above, the surface of the lower protective layer 20 or the intermediate layer 22 is roughened as required by etching. In addition, film deposition is preferably performed with a negative bias voltage being applied to the substrate in order to obtain a hard film by the plasma-assisted CVD.

To do this, the bias source 62 that applies a radio-frequency voltage to the substrate is connected to the substrate holder 64 in the film deposition apparatus 50. A radio-frequency self-bias voltage is preferably used in the plasma-assisted CVD.

On the foregoing pages, the thermal head of the invention has been described in detail but the present invention is in no way limited to the stated embodiments and various improvements and modifications can of course be made without departing from the spirit and scope of the invention.

As described above in detail, the present invention provides a thermal head with prolonged service life, said thermal head having a protective film which has significantly reduced corrosion and wear and which allows the thermal head to have a sufficient durability and reliability to ensure that thermal recording of high-quality images is consistently performed over an extended period of operation.

The invention will be further illustrated by means of the following specific examples.

EXAMPLES

As in conventional methods of producing a thermal head, the substrate 12 was overlaid with the accumulating layer 14, on which the heater 16 and the electrodes 18 were formed by sputtering, and a pattern was formed by photolithography and etching. A thermal head having no protective film was thus fabricated.

According to the procedure described below, a silicon nitride ($Si_3N_4$) film having a thickness of 7 $\mu$m was formed as the lower protective layer 20 on the thermal head obtained.

Formation of Lower Protective Layer 20

A conventional sputter device was used to perform film deposition by magnetron sputtering with an RF power of from 2 to 5 kW.

A SiN sintering agent was used as the target.

As for the gases to be introduced into the chamber for sputtering, 100 sccm to 200 sccm of argon was used as the carrier gas, and 2 sccm to 50 sccm of nitrogen gas and 2 sccm to 50 sccm of oxygen gas were used as the reactive gas. The total gas pressure (the internal pressure of the chamber) was set at 2 mTorr to 8 mTorr.

Prior to fabricating the thermal head, the relation between the ratio of the flow rates of the nitrogen and oxygen gases to the argon gas flow rate, and the oxygen content (atm %) in the silicon nitride film obtained was determined under the conditions for film deposition as described above. An energy dispersive X-ray spectrometer (EDX) was used for component analysis.

When forming the lower protective layer 20, the flow rate of each gas used for sputtering was adjusted based on the relation as determined above. Thus, three samples of thermal head each having a silicon nitride film as the lower protective layer 20, with the oxygen content being different from each other were fabricated. The oxygen content in the lower protective layer 20 of each sample is as follows: 1 atm % (Example 1), 5 atm % (Example 2) and 8 atm % (Comparative Example).

To control the thickness of the silicon nitride film, the deposition rate was determined previously and the time required to reach a specified film thickness was calculated.

The film deposition apparatus 50 described below and shown in FIG. 2 was used to form the intermediate layer 22 and the carbon protective layer 24 on the lower protective layer 20 that was previously formed on the three samples of thermal head.

Film Deposition Apparatus 50 a. Vacuum Chamber 52

The vacuum chamber 52 made of SUS 304 and having a capacity of 0.5 $m^3$ was used; the vacuum pump-down device 66 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 54

A mass flow controller permitting a maximum flow rate of 50 to 500 sccm and a stainless steel pipe having a diameter of 6 mm were used to form two gas introducing parts 54*a* and 54*b*, the former being used for introducing a plasma generating gas and the latter being used for introducing a reactive gas.

c. First and Second Sputter Devices 56, 58

The cathodes 68 and 76 used were in a rectangular form having a width of 600 mm and a height of 200 mm, with Sm—Co magnets being incorporated as the permanent magnets 68*a* and 76*a*. The backing plates 82 and 84 were rectangular oxygen-free copper members, which were attached to the cathodes 68 and 76 with In-based solder. The interior of the cathodes 68 and 76 was water-cooled to cool the magnets 68*a* and 76*a*, the cathodes 68 and 76 and the rear side of each of the backing plates 82 and 84.

The RF power supply 74 used had a frequency of 13.56 MHz and could produce a maximal output of 10 kW. The DC power supply 80 used was at negative potential capable of producing a maximal output of 10 kW. The DC power supply 80 was adapted to be capable of pulse modulation at frequencies in the range of 2 to 100 kHz in combination with the modulator.

d. Plasma Generating Device 60

The microwave source 86 oscillating at a frequency of 2.45 GHz and producing a maximal output of 1.5 kW was employed. The generated microwave was guided to the neighborhood of the vacuum chamber 52 by means of the microwave guide 90, converted in the coaxial transformer 92 and directed to the radial antenna 96 in the vacuum chamber 52.

The plasma generating part used was in a rectangular form having a width of 600 mm and a height of 200 mm.

A magnetic field for ECR was produced by arranging a plurality of Sm—Co magnets used as the magnets 88 in a pattern to conform to the shape of the dielectric plate 94.

e. Substrate Holder 64

The rotary base 98 was rotated to move the substrate holder 64 so that the substrate (the thermal head 10) fixed thereon is kept opposed to one of the targets 70 in the first and second sputter devices 56 and 58 and the radial antenna 96 in the plasma generating device 60.

The distance between the substrate and each target 70 was set at 100 mm when forming the intermediate protective layer 22 and the carbon protective layer 24 by sputtering as described below.

In addition, the area of the substrate holder 64 in which the thermal head was held was set at a floating potential in order to enable the application of an etching radio-frequency voltage. A heater was also provided on the surface of the substrate holder 64 for film deposition with heating.

f. Bias Source 62

An RF power supply was connected to the substrate holder 64 via the matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In this apparatus 50, the bias source 62 also serves as the etching means.

Formation of Intermediate Layer 22 and Carbon Protective Layer 24

In the film deposition apparatus 50, the thermal head 10 was secured to the substrate holder 64 such that the heating element (lower protective layer 20) would be kept opposed to the target 70 positioned in the first sputter device 56. All areas of the thermal head other than those where the intermediate protective layer 22 was to be formed were previously masked.

With continued pump-down, argon gas was introduced through the gas introducing section 54 and the pressure in the vacuum chamber 52 was adjusted to $5.0\times10^{-3}$ Torr by means of the orifice valve fitted on the turbomolecular pump. Subsequently, a radio-frequency voltage was applied to the substrate and the lower protective layer 20 (silicon nitride film) was etched for 10 minutes at a self-bias voltage of −300 V.

After the end of etching, a monocrystalline silicon target and a sintered graphite member were fixed (i.e., attached by means of In-based solder) on the backing plate 82 in the first sputter device 56 and on the backing plate 84 in the second sputter device 58, respectively. Then, the vacuum chamber 52 was evacuated again until the internal pressure reached $5.0\times10^{-6}$ Torr. The argon gas flow rate and the orifice valve were adjusted so as to maintain the internal pressure in the vacuum chamber 52 at $5.0\times10^{-3}$ Torr, and a RF power of 0.5 kW was applied to the target 70 for five minutes, with the shutter 72 being closed.

Subsequently, with the internal pressure in the vacuum chamber 52 kept at the stated level, the RF power was raised to 2 kW and the shutter 72 was opened. The sputtering was performed to form a silicon film as the intermediate protective layer 22 having a thickness of 0.2 $\mu$m.

To control the thickness of the silicon film, the deposition rate was determined previously and the time required to reach a specified film thickness was calculated.

After the intermediate layer 22 was formed, the rotary base 98 was rotated to oppose the heating element to the target 70 (i.e. the sintered graphite member) in the second sputter device 58. The argon gas flow rate and the orifice valve were adjusted so as to maintain the internal pressure in the vacuum chamber 52 at $2.5\times10^{-3}$ Torr, and a DC power of 0.5 kW was applied to the target 70 for 5 minutes with the shutter 78 being closed.

Subsequently, with the internal pressure in the vacuum chamber 52 kept at the stated level, the DC power was raised to 5 kW and the shutter 78 was opened. The sputtering was performed to form the carbon protective layer 24 having a thickness of 2 $\mu$m. The thermal head 10 of the invention which has a three-layer protective film comprising the lower protective layer 20, the intermediate layer 22 and the carbon protective layer 24 was thus obtained.

To control the thickness of the carbon protective layer 24 being formed, the deposition rate was determined previously and the time required to reach a specified film thickness was calculated.

Evaluation of Performance

Using the thus fabricated three samples of thermal head (Examples 1 and 2, and Comparative Example 1), thermal recording tests each corresponding to a solid image recording of 10 km were performed with a recording energy of 110 mJ/mm$^2$.

The results showed that any damage did not be found in Examples 1 and 2 in which the lower protective layer 20 contained 1 atm % and 5 atm % of oxygen, respectively; and that delamination of the protective film was found in Comparative Example in which the lower protective layer 20 contained 8 atm % of oxygen.

These results clearly demonstrate the effectiveness of the thermal head of the present invention.

What is claimed is:

1. A thermal head having a protective film of heating elements, said protective film comprising a carbon-based protective layer and a lower insulating protective layer which is composed of one or more sub-layers and formed below said carbon-based protective layer, wherein at least one of said sub-layers of said lower protective layer contains not more than 5 atm % of oxygen.

2. The thermal head according to claim 1, wherein one of said sub-layers which is located uppermost in said lower protective layer contains not more than 5 atm % of oxygen.

3. The thermal head according to claim 1, wherein said protective film further includes between said carbon-based protective layer and said lower protective layer, an intermediate protective layer which is based on at least one component selected from a group consisting of metals of Groups IVA, VA and VIA, and silicon and germanium, and which is composed of one or a plurality of sub-layers.

4. The thermal head according to claim 3, wherein said intermediate protective layer contains not more than 5 atm % of oxygen.

* * * * *